US005152218A

United States Patent [19]

Ishikawa

[11] Patent Number: 5,152,218

[45] Date of Patent: Oct. 6, 1992

[54] MIMEOGRAPHIC PRINTING MACHINE WITH SHEET SEPARATING MEMBER AND RESILIENT STENCIL SUPPORT

[75] Inventor: Makoto Ishikawa, Tokyo, Japan

[73] Assignee: Riso Kagaku Corporation, Tokyo, Japan

[21] Appl. No.: 685,081

[22] Filed: Apr. 15, 1991

[30] Foreign Application Priority Data

Apr. 24, 1990 [JP] Japan ..... 2-43020[U]

[51] Int. Cl.[5] ..... B41L 13/06

[52] U.S. Cl. ..... 101/118; 101/120

[58] Field of Search ..... 101/116, 117, 118, 119, 101/120, 127, 127.21, 408

[56] References Cited

U.S. PATENT DOCUMENTS 4,339,293 7/1982 Takahashi et al. ..... 101/116 X 5,035,175 7/1991 Takita et al. ..... 101/116

*Primary Examiner*—Clifford D. Crowder

*Attorney, Agent, or Firm*—Kanesaka and Takeuchi

[57] ABSTRACT

A mimeographic printing machine comprises a rotary cylindrical drum rotatable with a stencil supported thereon, an ink supply means for supplying ink to an inner circumferential surface of the cylindrical drum, a clamp disposed on an ink-impenetrable portion of the cylindrical drum for clamping an end of the stencil supported on the cylindrical drum, a stencil support disposed on the ink-impenetrable portion of the cylindrical drum, and peeling means disposed adjacent to the cylindrical drum. The stencil support resiliently contacts with the stencil clamped by the clamp. The peeling means approaches the cylindrical drum in timed relation with the rotation of the cylindrical drum, peeling a paper sheet after printed from the cylindrical drum.

6 Claims, 8 Drawing Sheets

MIMEOGRAPHIC PRINTING MACHINE WITH SHEET SEPARATING MEMBER AND RESILIENT STENCIL SUPPORT

BACKGROUND OF THE INVENTION

1. Field of the Invention:

This invention relates to a mimeographic printing machine having a rotary cylindrical drum, and more particularly to a mimeographic printing machine having a paper sheet discharge mechanism for discharging by a peeling claw a paper sheet after printed.

2. Description of the Related Art

As shown in FIGS. 7 and 8 of the accompanying drawings, a mimeographic printing machine is currently known which includes a rotary cylindrical drum 102 for supporting on its outer circumferential surface a stencil 101 whose one end is gripped by a clamp 100. In this type of conventional machine, an ink supply means is located inside the cylindrical drum 102. During printing, ink supplied from the ink supply means passes through pores of the stencil 101 and then is transferred to a paper sheet 103 which is supplied on the surface of the stencil 101.

For discharging a paper sheet upon completion of printing, the above-mentioned mimeographic printing machine is equipped with a paper sheet discharging mechanism including a peeling claw 104 located adjacent to the cylindrical drum 102. In use, a non-printed portion of the printed paper sheet 103 is peeled by the peeling claw 104 from the surface of the stencil 101. The peeled paper sheet 103 is then attracted to an endless belt 106 by a suction device 105 having a suction fan, and is conveyed on the endless belt 106 toward a discharge tray.

The peeling claw 104 is equipped so as to prevent such a phenomenon, in which the paper sheet 103 after printed remains stuck on the surface of the cylindrical drum 102 due to viscosity of ink on the stencil 101 and is not conveyed to the discharge tray. The peeling claw 104 is therefore indispensable in an automatic paper sheet discharge mechanism for the mimeographic printing machine. The peeling claw 104 repeatedly comes into contact with and out of contact with the surface of the cylindrical drum 102 in synchronization with the rotation of the cylindrical drum 102. Specifically, at a paper sheet discharging position, the peeling claw 104 is advanced into a gap between a leading end of the paper sheet 103 and the stencil 101, thereby peeling the printed paper sheets 103 in succession during printing.

When peeling the printed paper sheet from the cylindrical drum by the peeling claw, it is however mechanically difficult to have the peeling claw 104 advanced reliably into the gap between the stencil 101 and the leading end of the paper sheet 103, as shown in FIG. 8. Specifically, the peeling claw sometimes fails to advance into the above-mentioned gap due to factors such as a kind of paper sheets, viscosity of ink, or printing speed. In such a case, the paper sheet would be folded and enter into a gap between the cylindrical drum and the peeling claw, or would be damaged by the peeling claw.

SUMMARY OF THE INVENTION

It is therefore an object of this invention to provide a mimeographing printing machine having a paper sheet discharge mechanism in which the peeling claw can advance reliably into the gap formed between the stencil and the leading end of the paper sheet so as to peel the paper sheet from the stencil without damaging the stencil.

According to a first aspect of this invention, there is provided a mimeographic printing machine comprising: a frame; a rotary cylindrical drum including a cylinder having an ink-penetrable portion and an ink-impenetrable portion, the cylindrical drum being adapted to support a stencil on an outer circumferential surface thereof and being rotatable on the frame with the stencil supported thereon; an ink supply means disposed inside the cylindrical drum for supplying ink to an inner circumferential surface of the cylindrical drum; a clamp disposed on the cylindrical drum at the ink-impenetrable portion of the cylindrical drum for clamping an end of the stencil supported on the outer circumferential surface of the cylindrical drum; a stencil support disposed on the cylindrical drum at the ink-impenetrable portion adjacent to a leading end of the ink-penetrable portion of the cylindrical drum, the stencil support being adapted to resiliently contact with the stencil clamped by the clamp; and peeling means mounted on the frame at a position adjacent to the cylindrical drum, the peeling means being adapted to peel a paper sheet after printed from the cylindrical drum by approaching the cylindrical drum in timed relation with the rotation of the cylindrical drum and by pushing the stencil support via the stencil so as to define a gap between the stencil and the paper sheet.

In this arrangement, the stencil support may be a plate spring, a spongy member, or a plastic strip having opposite ends thereof fixed so as to bulge centrally.

According to a second aspect of this invention, there is provided a mimeographic printing machine comprising: a frame; a rotary cylindrical drum including a cylinder having an ink-penetrable portion and an ink-impenetrable portion, the cylindrical drum being adapted to support a stencil on an outer circumferential surface thereof and be rotatable on the frame with the stencil supported thereon; an ink supply means disposed inside the cylindrical drum for supplying ink to an inner circumferential surface of the cylindrical drum; a clamp disposed on the cylindrical drum at the ink-impenetrable portion thereof for clamping an end of the stencil supported on the outer circumferential surface of the cylindrical drum; a sheet separating member mounted on the cylindrical drum at the ink-impenetrable portion adjacent to a leading end of the ink-penetrable portion, the sheet separating member having a cutout on a part thereof and being adapted to contact with the stencil; a stencil support disposed on the cylindrical drum at a position corresponding to the cutout and being adapted to contact with the stencil resiliently; and peeling means mounted on the frame at a position adjacent to the cylindrical drum, the peeling means being adapted to peel a paper sheet after printed from the cylindrical drum by approaching the cylindrical drum in timed relation with the rotation of the cylindrical drum and by pushing the stencil support via the stencil so as to define a gap between the stencil and the paper sheet.

According to this invention, the peeling means comes into contact with the stencil supported on the outer circumferential surface of the cylindrical drum at timed relation with the cylindrical drum. The portion of the stencil with which the peeling means contacts is supported by the resilient stencil support. Therefore, this portion of the stencil is pushed by the peeling means and sinks together with the stencil support so that a gap is defined between the stencil and the paper sheet on the stencil. The peeling means then advances into the gap, thereby peeling the paper sheet from the stencil.

The above and other advantages, features and additional objects of this invention will be manifest to those versed in the art upon making reference to the following detailed description and the accompanying drawings in which preferred embodiments incorporating the principles of this invention is shown by way of illustrative example.

DETAILED DESCRIPTION

The principles of this invention are particularly useful when embodied in a mimeographic printing machine such a shown in FIGS. 1 through 6.

Figure 1:
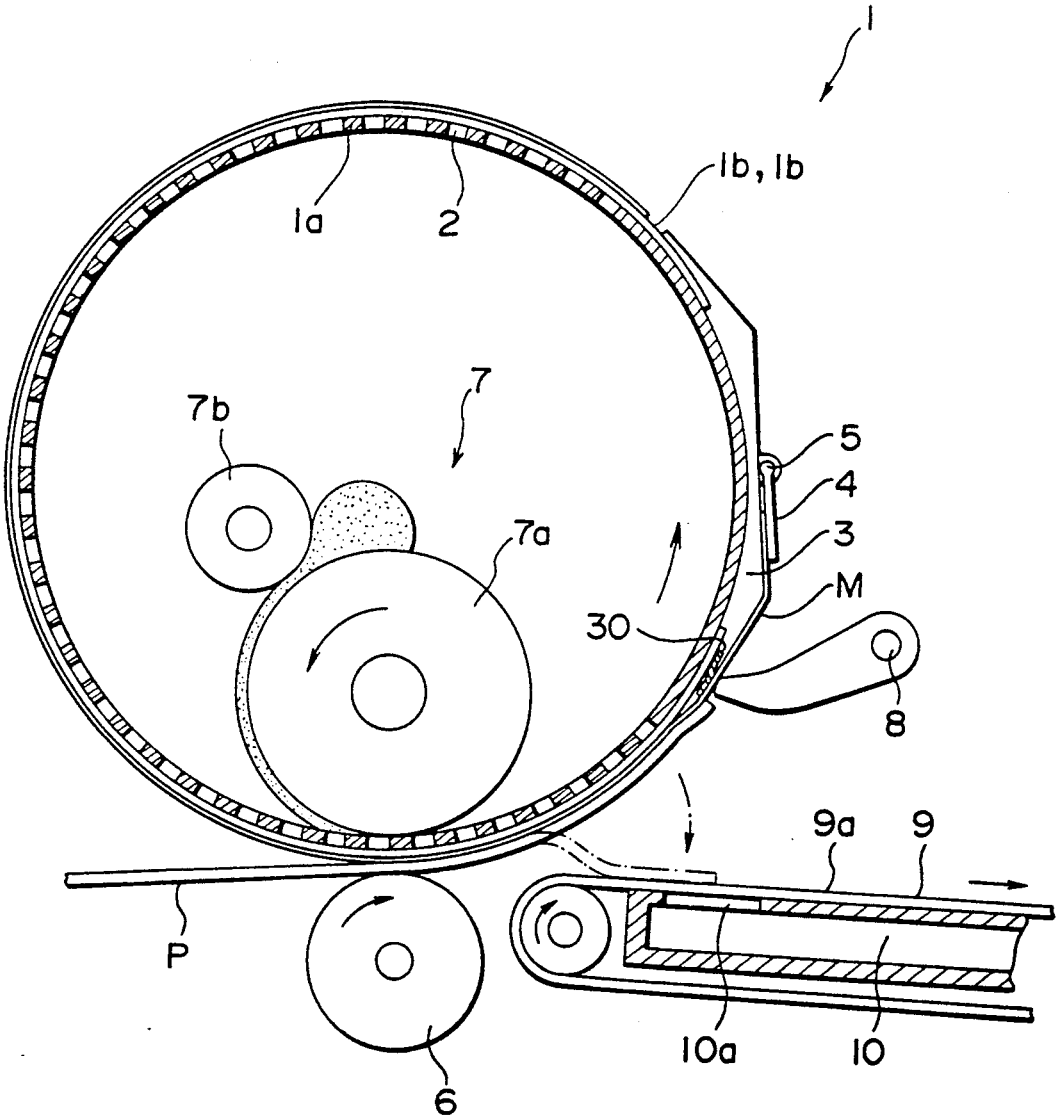
FIG. 1 is a fragmentary transverse cross-sectional view of a mimeographic printing machine embodying this invention.

As shown in FIG. 1, reference numeral 1 designates a rotary cylindrical drum, which includes a cylinder 1*a* whose opposite ends are composed of a pair of annular members. The cylinder la has on its circumferential surface a multiplicity of ink-penetrable pores 2. The cylinder la has two layers of ink-penetrable screens 1*b*, 1*b* on its circumferential surface. A stencil mount 3 is located on the outer circumferential surface of the cylinder la in the longitudinal direction thereof. A clamp plate 4 serving as a clamp is movably mounted on the stencil mount 3 via a pivot 5. The clamp plate 4 is moved pivotally by a non-illustrated drive means.

The cylindrical drum 1 is driven for rotation by a suitable drive means. A lower pusher roller 6 is located under the cylindrical drum 1 as shown in FIG. 1. The paper sheet P as a printing medium is introduced between the cylindrical drum 1 and the lower pusher roller 6.

As shown in FIG. 1, an ink supply means 7 is located inside the cylindrical drum I so as to supply ink to the inner circumferential surface of the cylinder 1*a* of the cylindrical drum 1. The ink supply means 7 includes a squeegee roller 7*a*, which is rotatable in contact with the inner circumferential surface of the cylinder 1*a*, and a doctor roller 7*b* located near the squeegee roller 7*a* with a predetermined space. These rollers 7*a*, 7*b* rotate to supply ink to the inner circumferential surface of the cylinder 1*a*. The clamp plate 4 and the stencil mount 3 grip a leading end of the stencil M to be supported on the circumferential surface of the ink-penetrable screen 1*b* of the cylindrical drum 1.

Figure 3:
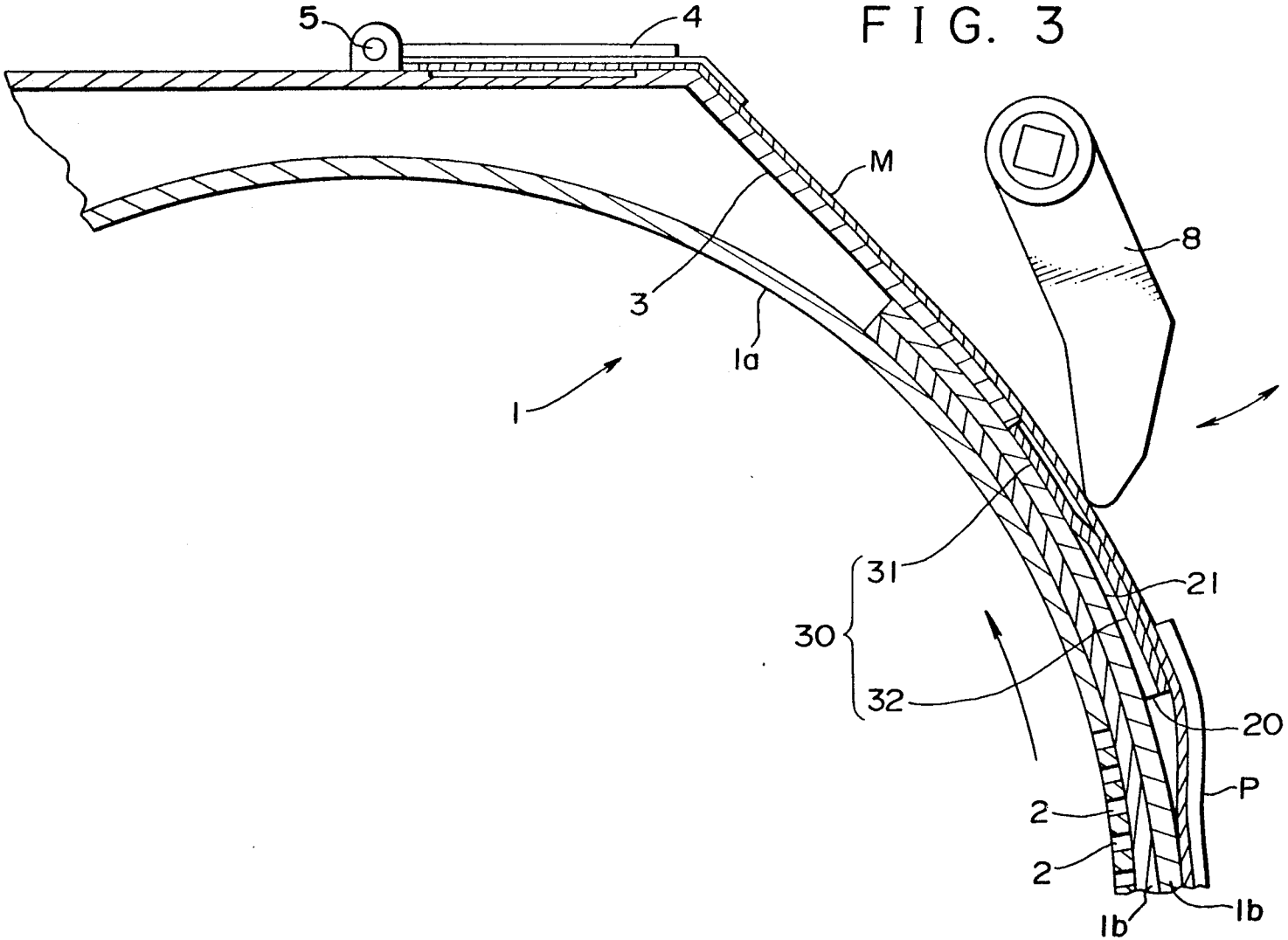
FIG. 3 is an enlarged fragmentary cross-sectional view of the cylindrical drum.

Adjacent to the outer circumferential surface of the cylindrical drum 1, a peeling claw 8 is located so as to peel the paper sheet P after printed from the surface of the cylindrical drum 1 as shown in FIGS. 1 and 3. The peeling claw 8 is adapted to come into contact with and out of contact with the cylindrical drum 1 in timed relation with the rotation of the cylindrical drum 1. The peeling claw 8 advances into the gap between the stencil M and the paper sheet P, to peel the paper sheet P from the cylindrical drum 1. The paper sheet P is then conveyed to a non-illustrated discharge tray by discharge means to be described below.

As shown in FIG. 1, a belt conveyor 9 is used as a paper sheet discharge means. The belt conveyor 9 includes an endless belt 9*a* made of an air-passing material or having an air-passing structure, and a box 10 which is located inside the conveyor belt 9 and has an air intake 10*a* at a position corresponding to the peeling claw 8. A negative pressure is generated in the box 10 by a blower, for example. Therefore, the paper sheet P peeled from the cylindrical drum 1 will be attracted onto the endless belt 9*a* of the belt conveyor 9.

Figure 2:
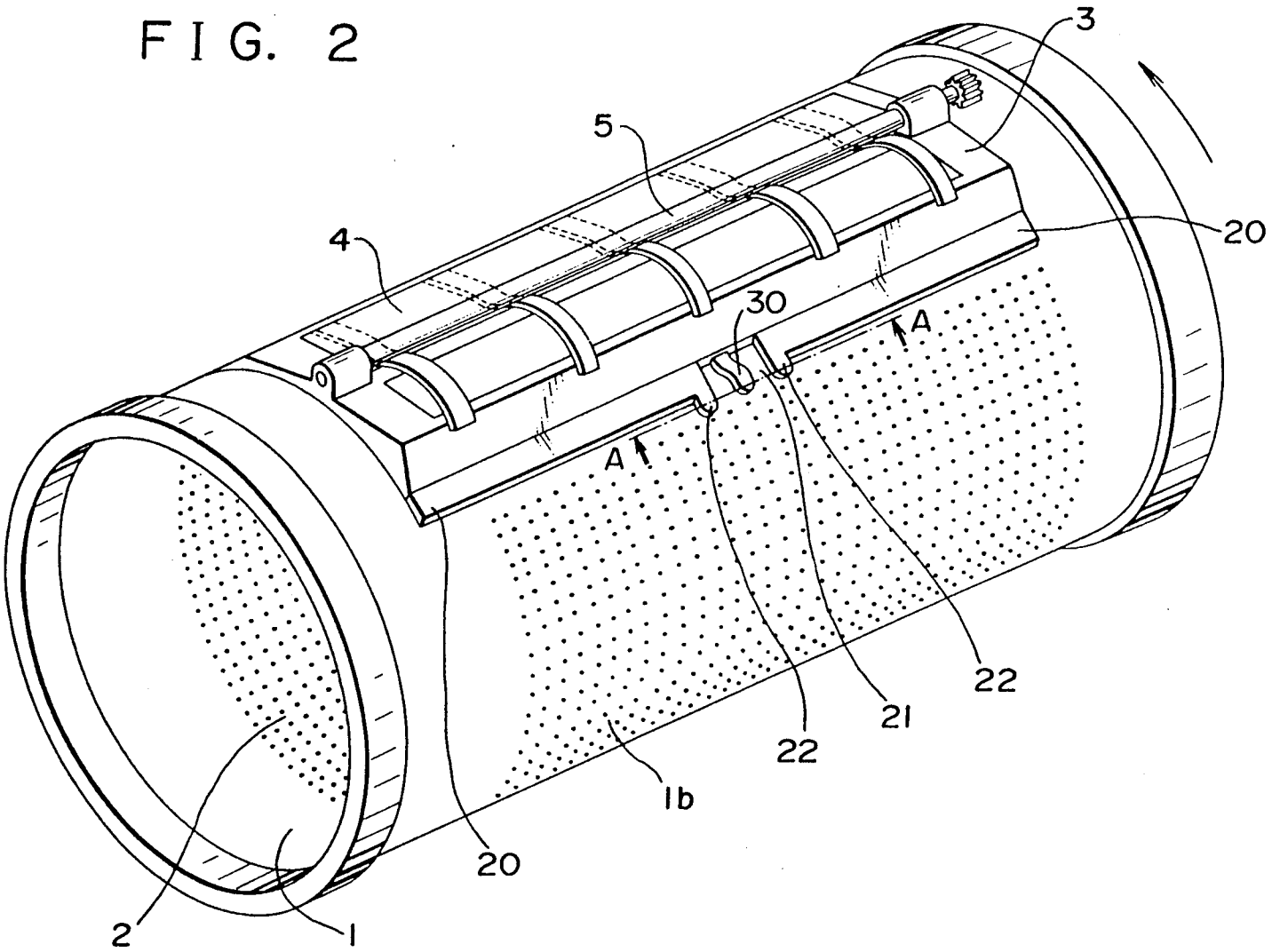
FIG. 2 is a perspective view of a cylindrical drum of the mimeographic printing machine of FIG. 1.
Figure 4:
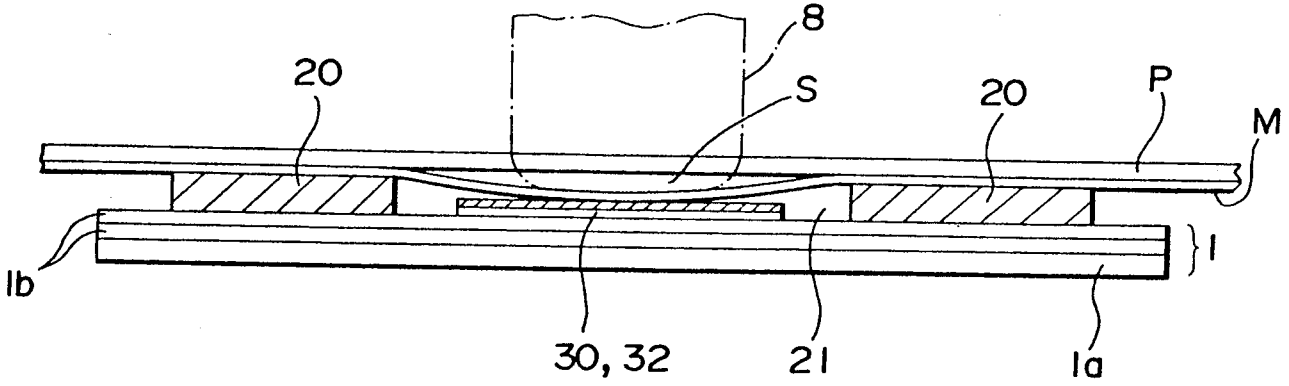
FIG. 4 is a cross-sectional view of the cylindrical drum, taken along the line A—A of FIG. 2.

A sheet separating member 20 will be described with reference to FIGS. 2 to 4. The sheet separating member 20 is in strip form to assist the peeling claw 8 in peeling the paper sheet P from the stencil M on the cylindrical drum 1. The sheet separating member 20 is mounted lengthwise on the cylindrical drum 1 at a position adjacent to the stencil mount 3. The sheet separating member 20 has at its central portion a cutout 21, and a pair of tongues 22, 22 which are on opposite sides of the cutout 21 and extend toward the upstream side of the cylindrical drum 1. Edges of the tongues 22, 22 reach the ink-penetrable portion of the cylindrical drum 1 where the ink-passing pores exist.

When a stencil M is supported somewhat tensely on the outer circumferential surface of the cylindrical drum 1, the stencil M is slackened to the cylindrical drum 1 at the cutout 21 of the sheet separating member 20. Since there exists a gap between the stencil M and the paper sheet P at the cutout 21, the peeling claw 8 is adapted to advance into the gap. Therefore, the paper sheet P will be peeled from the stencil M more smoothly compared with that with the conventional apparatus.

In addition, the stencil M pressed and recessed to the cylindrical drum 1 at the cutout 21 forms gaps not only with the paper sheet P but also with the outer circumferential surface of the cylindrical drum 1. Specifically, in the cutout 21, the stencil M is floating from the cylindrical drum 1. The peeling claw 8 sometimes may contact with such floating stencil M, thereby damaging the stencil M, even if the peeling claw 8 is poorly adjusted.

In order to prevent such inconvenience, in this embodiment, a stencil support 30 is mounted on the cylindrical drum at a position corresponding to the center of the cutout 21, thereby supporting the stencil M. The stencil support 30 is made of a resilient, thin metallic plate spring, which is divided into a base 31 and an arm 32. Specifically the base 31 of the stencil support 30 is mounted fixedly on the cylindrical drum 1 at a portion corresponding to the cutout 21. The arm 32 extends upwardly from the base 31 so as to contact with the rear side of the stencil M at a height flush with the separating member 20. Since it has a smooth surface, the arm 32 does not damage the rear surface of the stencil M when the peeling claw 8 pushes the arm 32 via the stencil M.

The operation of the mimeographic printing machine will now be described.

First of all, the leading end of the stencil M is gripped on the stencil mount 3 by the clamp plate 4 and is then wound on the outer circumferential surface of the cylindrical drum 1 with applying a predetermined tension.

As shown in FIG. 3, the rear surface of the stencil M over the cutout 21 of the sheet separating member 20 is supported by the arm 32 of the stencil support 30.

The paper sheet P is supplied to the cylindrical drum 1 in rotation. Printing is performed on the paper sheet P by the operation of the cylindrical drum 1, the ink supply means 7 and the pusher roller 6. The paper sheet P after printed is peeled by the peeling claw 8 from the stencil M on the cylindrical drum in timed relation with the printing operation.

When the peeling claw 8 depresses the stencil M at the cutout 21 of the separating member 20, the arm 32 of the stencil support 30 is also depressed in the cutout 21 toward the cylindrical drum 1. The stencil M also sinks into the cutout 21, thereby forming a gap S between the stencil M and the paper sheet P.

The edge of the peeling claw 8 advances between the stencil M and the paper sheet P through the gap S in synchronization with the rotation of the cylindrical drum 1. As the cylindrical drum 1 continues rotating, the peeling claw 8 peels the paper sheet P from the stencil M, which is then conveyed toward the discharge means.

Only while the peeling claw 8 is in contact with the stencil M, the gap S is formed between the stencil M and the paper sheet P, and the stencil support 30 is depressed in the cutout 21. When the peeling claw 8 leaves from the paper sheet P, the stencil support 30 returns to its normal condition.

According to this embodiment, the stencil support 30 resiliently contacts with the stencil M only when the peeling claw 8 contacts with the stencil M, thereby forming the gap S for the peeling claw 8 between the stencil M and the paper sheet P. Therefore the paper sheet P can be separated safely from the stencil M without damaging the stencil M, without causing the paper sheet P to be folded and to enter between the outer circumferential surface of the cylindrical drum 1 and the peeling claw 8, or without damaging the paper sheet P by the peeling claw 8. In addition, since the arm 32 of the stencil support 30 has a smooth surface, the arm 32 does not damage the stencil M with a frictional resistance when the stencil M is pushed by the peeling claw 8.

In the foregoing embodiments, although the stencil support 30 is made of a metallic plate spring, it may be of plastics. In addition, the stencil support 30 may be of a spongy member, which has a tape with a smooth surface applied to the side in contact with the stencil. Such stencil support 30 is also as effective as that in the foregoing embodiment.

According to the second embodiment, the sheet separating member having the cutout is located on the outer circumferential surface of the cylindrical drum at such a position that the cutout corresponds to the peeling means. In addition, the resilient stencil support is mounted on the cylindrical drum at the position corresponding to the cutout of the sheet separating member. Only when the peeling means comes into contact with the stencil through the cutout, the stencil support and a part of the stencil are depressed, thereby forming the gap between the paper sheet and the stencil. Therefore, the printed paper sheet can be safely peeled from the cylindrical drum without damaging the stencil.

Figure 5:
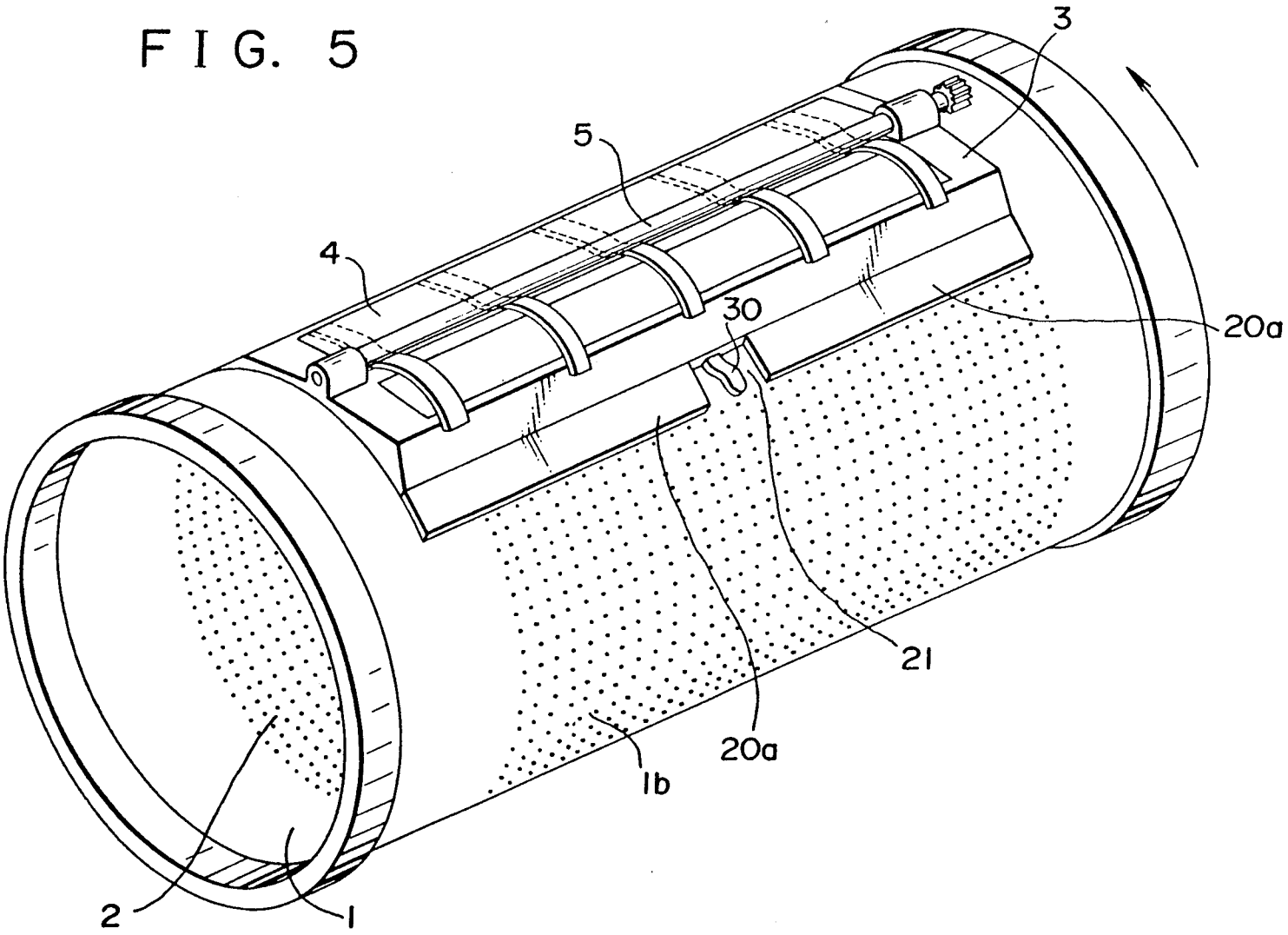
FIG. 5 is a perspective view of a cylindrical drum of a mimeographic printing machine according to a second embodiment of this invention.

FIG. 5 shows a further embodiment of this invention. A paper sheet separating member 20*a* differs from the separating member 20 shown in FIG. 2 in that the separating member 20*a* does not have tongues 22, 22 and that the separating member 20*a* is wider in the rotating direction of the cylindrical drum 1. The separating member of this embodiment is as effective as that in the first embodiment.

In the foregoing embodiments, the sheet separating member 20 or 20*a* is located adjacent to the stencil mount 3 together with the stencil support 30. It is possible to mount only the stencil support 30 at the central portion of the circumferential surface of the cylinder 1*a* so as to support the stencil M. In addition, when only the sheet separating member 20 or 20*a* is mounted on the cylindrical drum 1 in the direction of length thereof so as to support the stencil M, the stencil M wound on the cylindrical drum with a certain tension would be relatively free from wrinkles which would result in tearing of the stencil.

Figure 6:
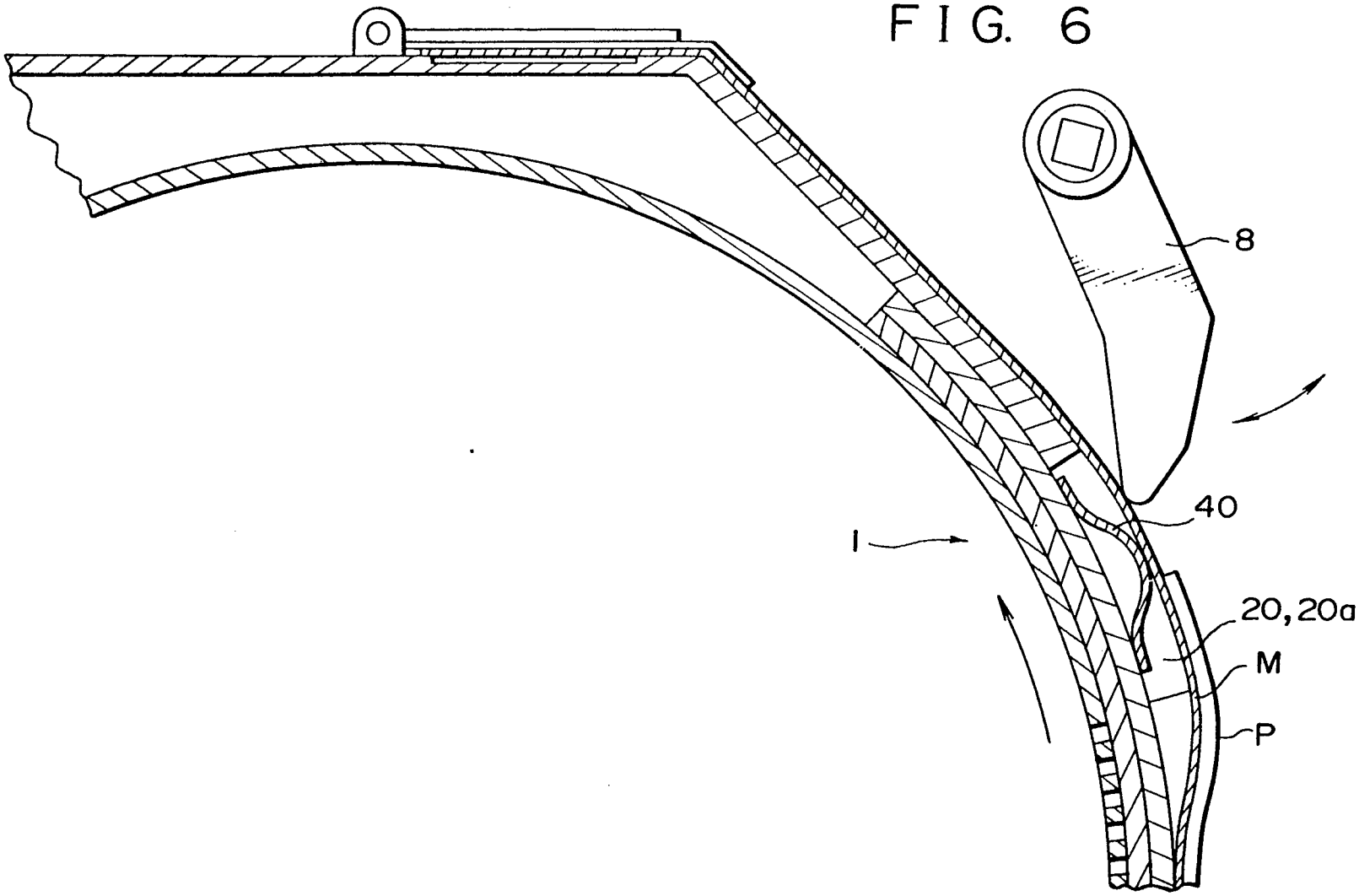
FIG. 6 is an enlarged fragmentary cross-sectional view of a cylindrical drum according to a third embodiment of the invention.
Figure 7:
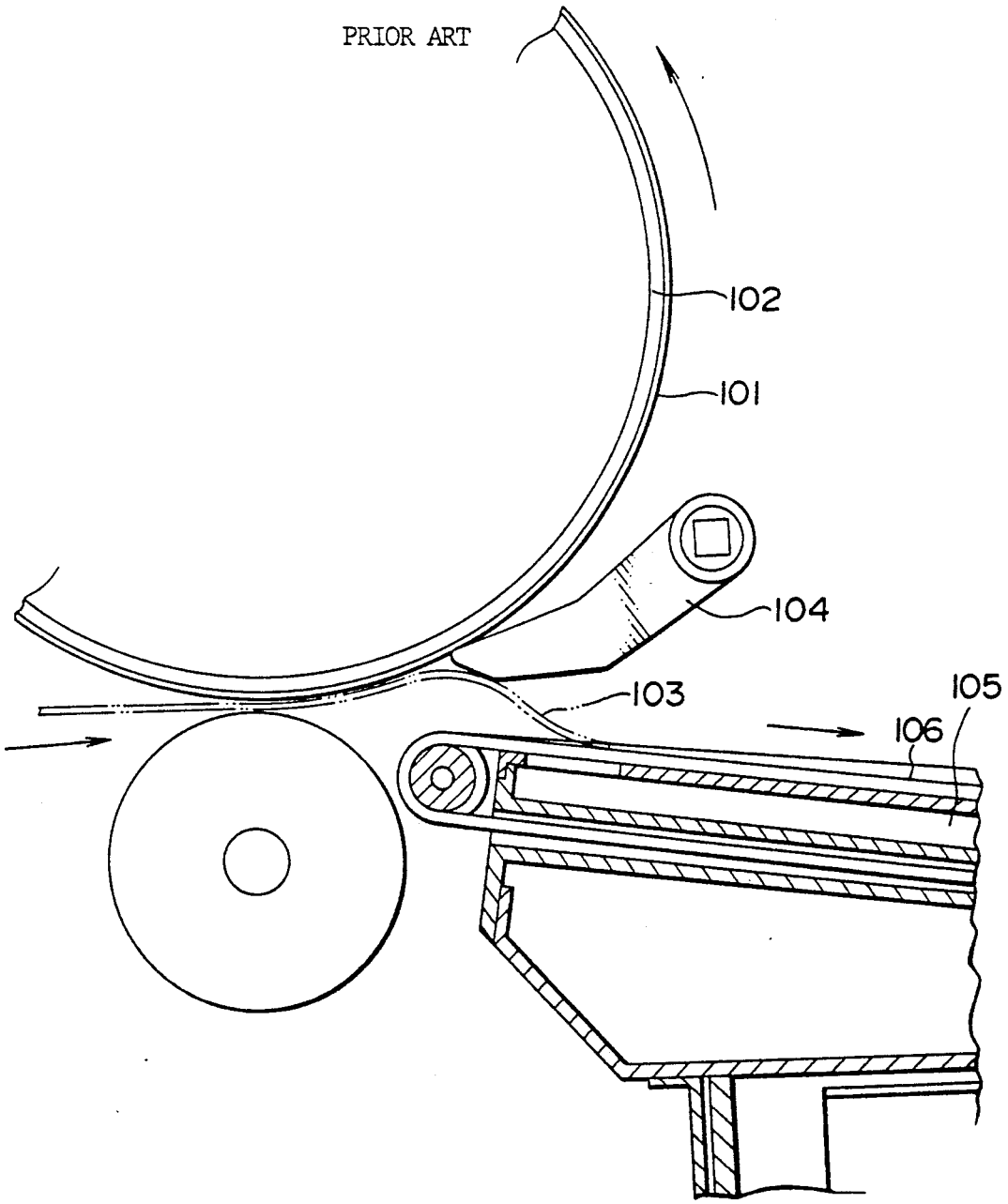
FIG. 7 PRIOR ART
FIG. 7 is a fragmentary cross-sectional view of a cylindrical drum in a conventional mimeographic printing machine.
Figure 8:
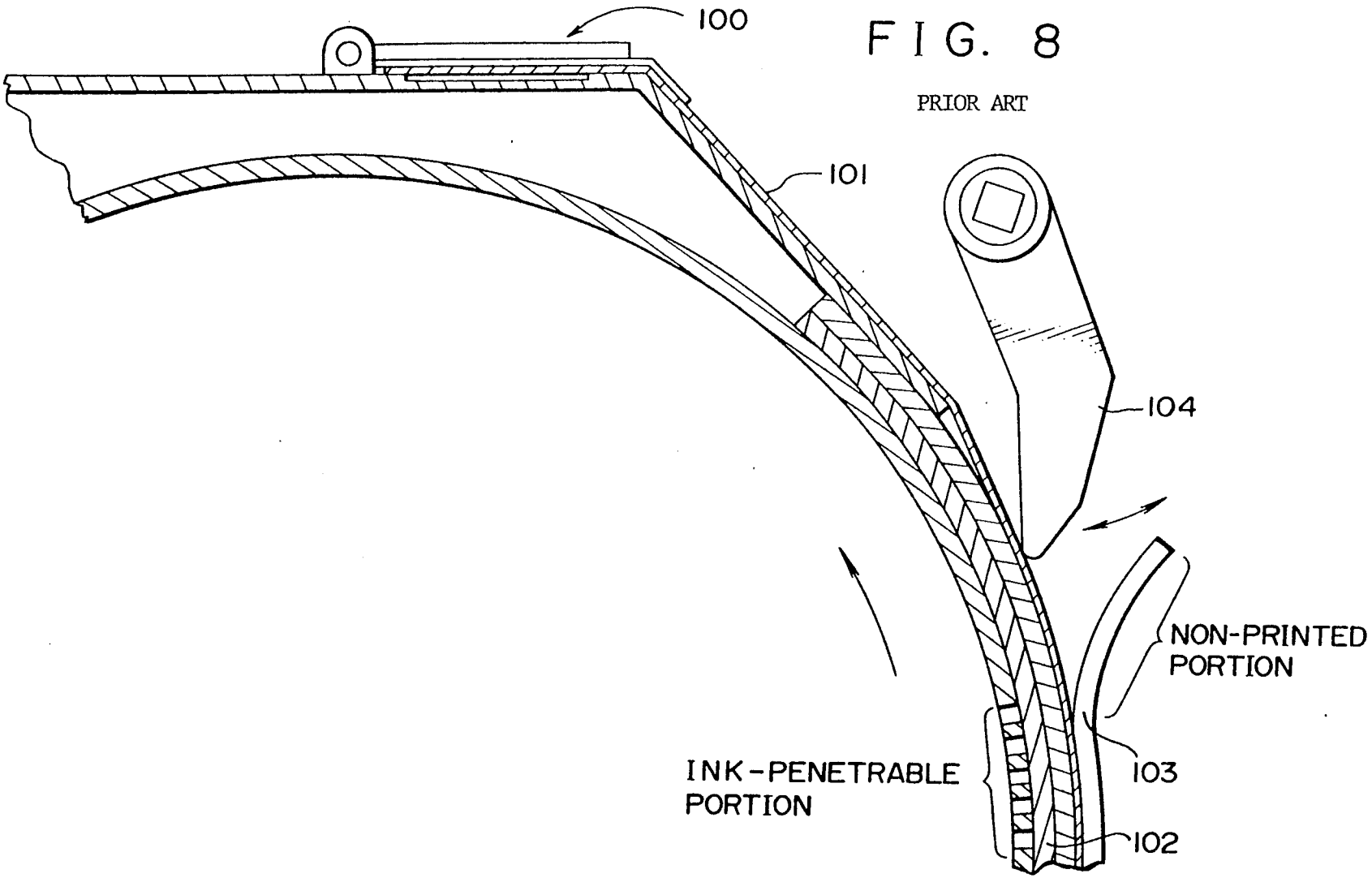
FIG. 8 PRIOR ART
FIG. 8 is an enlarged fragmentary cross-sectional view of the cylindrical drum of FIG. 7.

Although the stencil supports 30 in the above embodiments are of a plate spring and a sponge, they may be of any material, shape or structure which is resilient whenever applied with pressure. For example, a rubber block may be used in place of the sponge. In such a case, it is preferable that the surface of the rubber block is polished not to damage the stencil. In addition, the stencil support 30 may be of a plastic sheet 40 in strip shape as shown in FIG. 6. In this case, opposite side edges of the plastic sheet 40 are fixed on the cylindrical drum 1 so that the plastic sheet 40 bulges centrally so as to form a gap with the cylindrical drum 1.

What is claimed is:

1. A mimeographic printing machine comprising:

(a) a frame;

(b) a rotary cylindrical drum including a cylinder having an ink-penetrable portion with a leading end, and ink-impenetrable portion, and inner and outer circumferential surfaces, said cylindrical drum being adapted to support a stencil on the outer circumferential surface thereof and being rotatable on said frame with the stencil supported thereon;

(c) ink supply means disposed inside said cylindrical drum for supplying ink to the inner circumferential surface of said cylindrical drum;

(d) a clamp disposed on said cylindrical drum at said ink-impenetrable portion of said cylindrical drum for clamping an end of the stencil supported on the outer circumferential surface of said cylindrical drum;

(e) a stencil support disposed on said cylindrical drum at said ink-impenetrable portion adjacent to the leading end of said ink-penetrable portion of said cylindrical drum, said stencil support having resiliency to be pushed toward the cyulindrical drum when urged and to resiliently support the stencil clamped by said clamp; and (f) peeling means mounted on said frame at a position adjacent to said cylindrical drum, said peeling means being adapted to peel a paper sheet after printed from said cylindrical drum on approaching said cylindrical drum in timed relation with the rotation of said cylindrical drum and on pushing said stencil support via the stencil said s to define a gap between the stencil and the paper sheet.

2. A mimeographic printing machine according to claim 1, wherein said stencil support is a plate spring including a base fixedly mounted on said cylindrical drum and an arm extending upwardly from said base.

3. A mimeographic printing machine according to claim 1, wherein said stencil support is a spongy member fixedly mounted on said cylindrical drum so as to contact with the stencil resiliently.

4. A mimeographic printing machine according to claim 1, wherein said stencil support is of a plastic member in strip shape and is mounted on said cylindrical drum with opposite ends thereof fixed on said cylindrical drum so as to be centrally bulging and define a gap with said cylindrical drum.

5. A mimeographic printing machine according to claim 1, wherein said stencil support is located beneath the stencil when installed on the cylindrical drum so that the stencil is resiliently supported by the stencil support while being pushed toward the cylindrical drum by the peeling means when the paper sheet is peeled from the drum.

6. A mimeographic printing machine comprising:

(a) a frame;

(b) a rotary cylindrical drum including a cylinder having an ink-penetrable portion with a leading end, an ink-impenetrable portion, and inner and outer circumferential surfaces, said cylindrical drum being adapted to support a stencil on the outer circumferential surface thereof and being rotatable on said frame with the stencil supported thereon;

(c) ink supply means disposed inside said cylindrical drum for supplying ink to the inner circumferential surface of said cylindrical drum;

(d) a clamp disposed on said cylindrical drum at said ink-impenetrable portion thereof for clamping an end of the stencil supported on the outer circumferential surface of said cylindrical drum;

(e) a sheet separating member mounted on said cylindrical drum at said ink-impenetrable portion adjacent to the leading end of said ink-penetrable portion, said sheet separating member having a cutout on a part thereof and being adapted to contact with the stencil;

(f) a stencil support disposed on said cylindrical drum at a position corresponding to said cutout and having resiliency to support thereon the stencil resiliently; and (g) peeling means mounted on said frame at a position adjacent to said cylindrical drum, said peeling means being adapted to peel a paper sheet after printed from said cylindrical drum on approaching said cylindrical drum in timed relation with the rotation of said cylindrical drum and on pushing said stencil support via the stencil so as to define a gap between the stencil and the paper sheet.

* * * * *